US007591042B2

(12) United States Patent
Kim

(10) Patent No.: US 7,591,042 B2
(45) Date of Patent: Sep. 22, 2009

(54) UPRIGHT VACUUM CLEANER

(75) Inventor: Kyung Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 712 days.

(21) Appl. No.: 11/098,549

(22) Filed: Apr. 5, 2005

(65) Prior Publication Data

US 2006/0021186 A1 Feb. 2, 2006

(30) Foreign Application Priority Data

Jul. 27, 2004 (KR) ..... 10-2004-0058521

(51) Int. Cl.
*A47L 9/32* (2006.01)

(52) U.S. Cl. ..... 15/331; 15/334; 15/350; 15/351; 15/410

(58) Field of Classification Search ..... 15/350, 15/351, 410; *A47I 9/32*
See application file for complete search history.

(56) References Cited

U.S. PATENT DOCUMENTS

| | | | | |
|---|---|---|---|---|
| 6,079,080 | A * | 6/2000 | Rutter et al. | 15/410 |
| 2002/0092115 | A1 * | 7/2002 | Zahuranec et al. | 15/320 |
| 2006/0070204 | A1 * | 4/2006 | Blocker et al. | 15/334 |

* cited by examiner

*Primary Examiner*—David A Redding
(74) *Attorney, Agent, or Firm*—KED & Associates LLP

(57) ABSTRACT

Provided is an upright vacuum cleaner including a carrying handle formed at an upper surface of the vacuum cleaner and conveniently gripped by a user while being transferred, the carrying handle having a hose seat surface on which a hose is seated such that a user conveniently uses the vacuum cleaner.

16 Claims, 4 Drawing Sheets

UPRIGHT VACUUM CLEANER

BACKGROUND OF THE INVENTION

1. Field of the Invention

The present invention relates to a vacuum cleaner, and particularly to an upright vacuum cleaner enabling a convenient grasp and handling by a user. Further, the invention relates to a carrying handle of an upright vacuum cleaner that can prevent unnecessary shaking of the vacuum cleaner and enable a user to transfer it more conveniently.

2. Description of the Related Art

A vacuum cleaner is generally classified into a canister vacuum cleaner and an upright vacuum cleaner. Particularly, the upright vacuum cleaner includes a main body, a nozzle unit and a handle that are integrally formed. In detail, a suction nozzle, a motor, a suction fan and the like are accommodated in the main body of the vacuum cleaner to generate a suction force of air and filter foreign particles from the sucked air. The nozzle unit is formed at a lower side of the main body to suck air on a floor together with foreign particles. The handle is formed at an upper side of the main body so that a user may hold the handle with ease and handle the vacuum cleaner.

In cleaning operation using the upright vacuum cleaner, as a user holding the handle pushes and pulls the nozzle unit, the vacuum cleaner moves to a desired position, dirt on a floor is sucked into the main body of the vacuum cleaner, and the sucked dirt is filtered by the main body.

Also, the general upright vacuum cleaner has a difficulty in cleaning a stair or a corner because the nozzle unit, the main body and the handle are formed integrally. To solve such a problem, a long and flexible extension tube wound on upper and lower circumference of the main body is installed. To fix the extension tube to the circumference of the main body of the vacuum cleaner, a pair of protrusions are protruded from the circumference of the main body. The extension tube is latched on the protrusions. In cleaning a place such as a stair or the like, the extension tube is separated from the protrusions and then a nozzle is connected to an end of the extension tube.

In the meanwhile, cleaning of a floor is performed by pushing or pulling the handle formed at the upper side of the vacuum cleaner. However, in case the vacuum cleaner is transferred to a place passing through a stair of a building or a distant place, the handle fails to support an overall weight of the vacuum cleaner, which is undesirable. Accordingly, it is more general that a carrying handle capable of supporting the overall weight of the vacuum cleaner should be additionally provided.

However, since the carrying handle of the related art vacuum cleaner is formed at a rear side of the vacuum cleaner, it does not accord with a center of gravity of the vacuum cleaner. So, when a user moves the vacuum cleaner, the vacuum cleaner leans to one direction, so that the user collides with the vacuum cleaner.

Also, since the vacuum cleaner further needs a protrusion structure for fixing the extension tube, a more complicated fabrication process is required.

SUMMARY OF THE INVENTION

Accordingly, the present invention is directed to an upright vacuum cleaner that substantially obviates one or more problems due to limitations and disadvantages of the related art.

An object of the invention is to provide an upright vacuum cleaner having a carrying handle and enabling a user to transfer the vacuum cleaner conveniently.

Another object of the invention is to provide an upright vacuum cleaner having a simplified structure by integrally forming a carrying handle and a hose seat.

A further object of the invention is to provide an upright vacuum cleaner that has a simple structure, can be fabricated by a simple method, and allows a user to use it conveniently.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an upright vacuum cleaner comprising: a suction nozzle unit through which outer air is sucked; a main body through which air sucked through the suction nozzle unit is introduced; a hose connected to the suction nozzle unit and the main body, for introducing the air sucked through the suction nozzle unit into the main body; a carrying handle having an upper surface on which the hose is seated and gripped by a user while being transferred; and a manipulation handle formed at an upper portion of the main body and gripped by a user during a cleaning operation to hold and manipulate the vacuum cleaner.

In another aspect of the invention, there is provided an upright vacuum cleaner comprising: a suction nozzle unit through which outer air is sucked; a main body through which air sucked through the suction nozzle unit is introduced; a flexible and extendable hose connected to the suction nozzle unit and the main body, for introducing the air sucked through the suction nozzle unit into the main body; a carrying handle on which the hose is seated, gripped by a user while transferring the main body, and formed integrally with and spaced apart by a predetermined distance from the main body; and a manipulation handle extending upward from a rear side of the carrying handle and gripped by a user during a cleaning operation to hold and manipulate the vacuum cleaner.

In another aspect of the invention, there is provided an upright vacuum cleaner comprising: a nozzle formed at a lower side of the vacuum cleaner, through which outer air is sucked; a main body including at least a dust collection unit; a carrying handle formed at an upper surface of the main body and conveniently gripped by a user while wholly transferring the vacuum cleaner; and a hose separatably and fixedly seated on an upper surface of the carrying handle, for guiding the air sucked through the nozzle to the main body.

According to the upright vacuum cleaner provided in the present invention, convenience in using the vacuum cleaner is enhanced. Also, since an additional element can be reduced, the convenience is further enhanced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
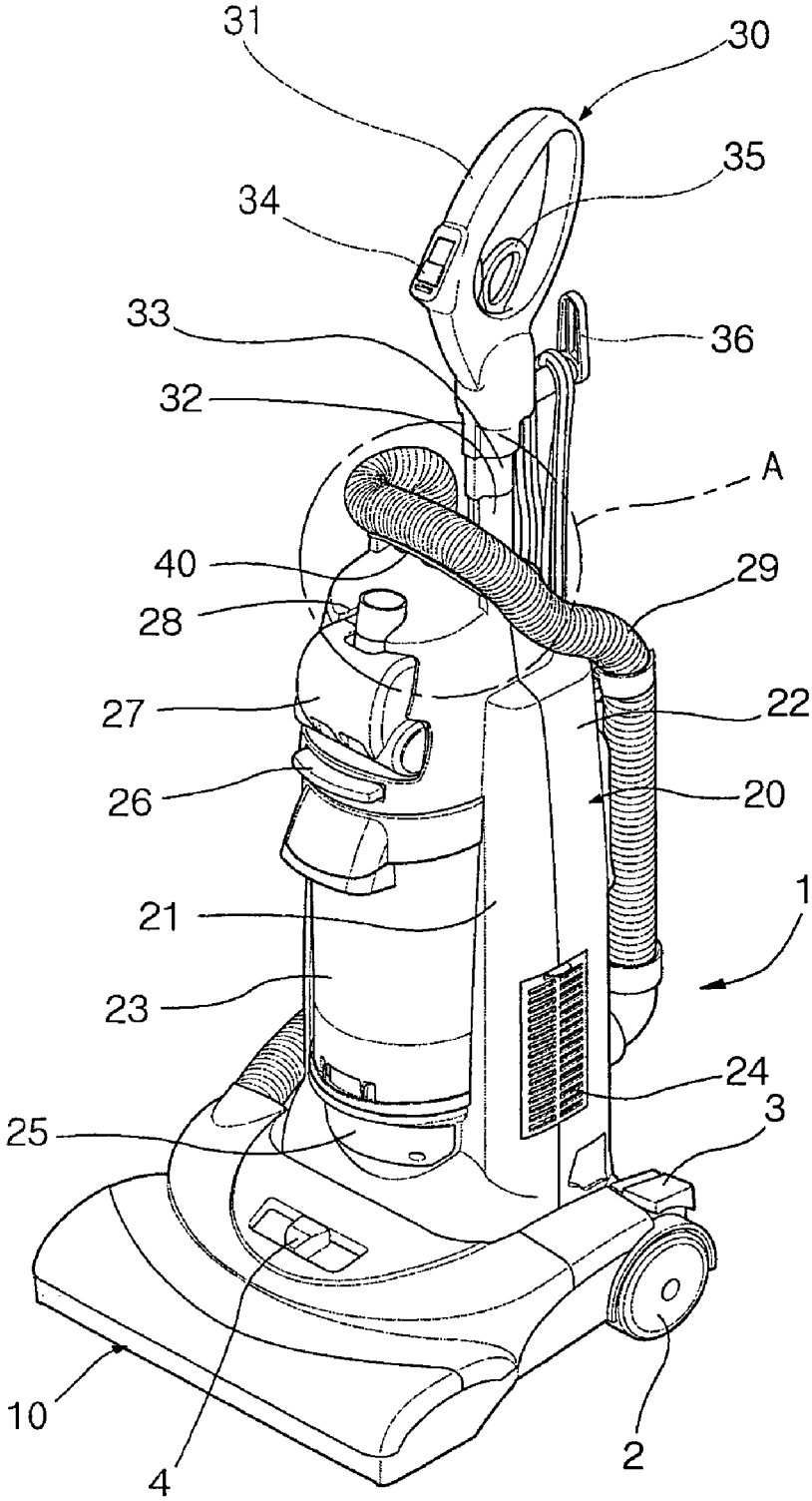
FIG. 1 is a front perspective view of an upright vacuum cleaner according to the present invention.
Figure 2:
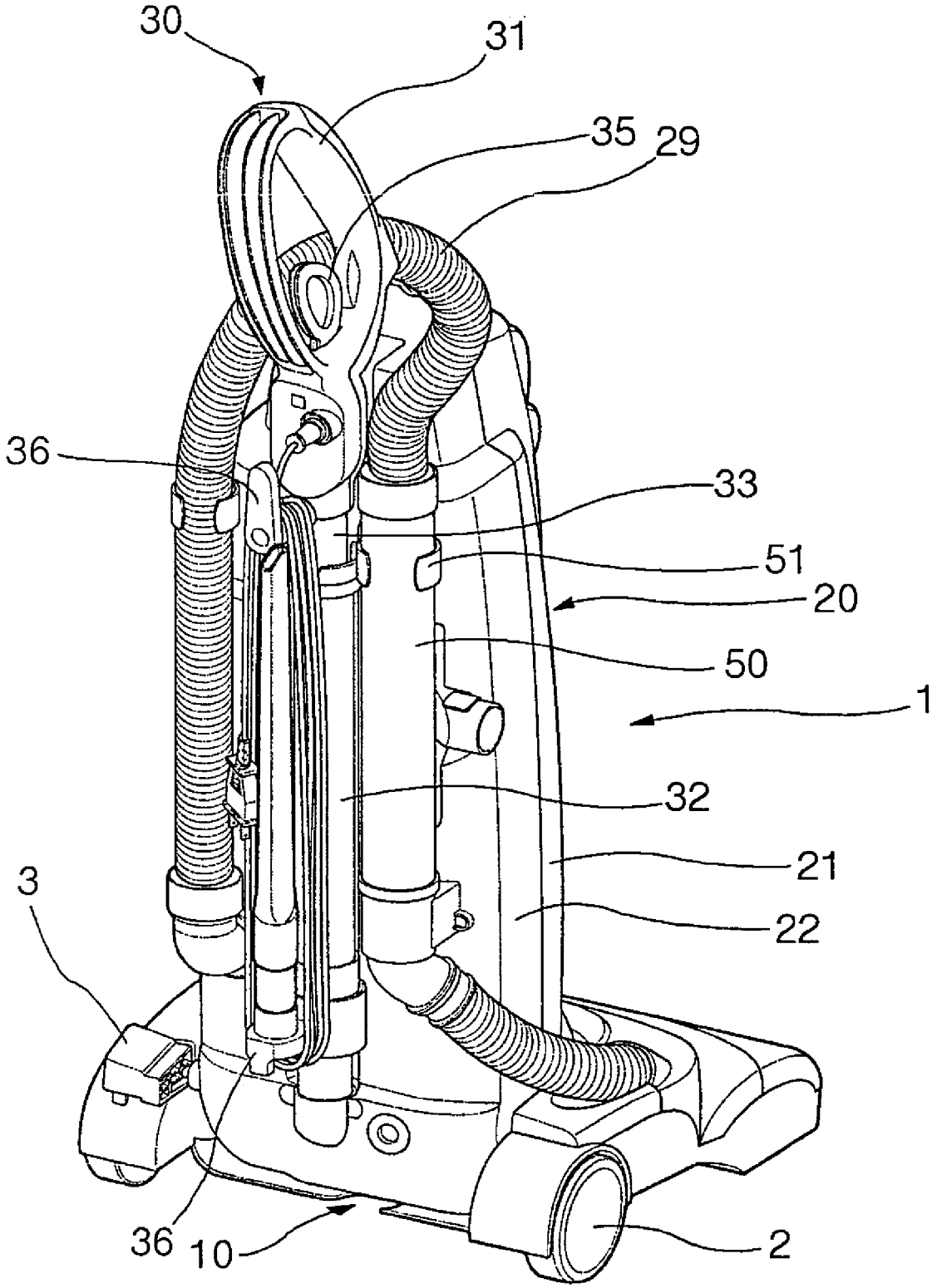
FIG. 2 is a rear perspective view of an upright vacuum cleaner according to the present invention.

FIG. 1 is a front perspective view of an upright vacuum cleaner according to the present invention, and FIG. 2 is a rear perspective view of the upright vacuum.

Referring to FIGS. 1 and 2, the upright vacuum cleaner 1 macroscopically includes a suction nozzle unit 10 contacts with a floor to suck outer air, a main body 20 in which main parts including a suction motor and a fan are mounted, and a manipulation handle 30 formed on an upper portion of the vacuum cleaner such that the vacuum cleaner is moved in an easy way during the cleaning work. The cleaning work using the vacuum cleaner is conducted as follows. First, air is sucked through the suction nozzle unit 10 together with foreign particles. The foreign particles are separated from the sucked air while passing through the main body 20 and cleaned, and then the cleaned air is exhausted through a predetermined discharge hole. In addition, in order to move the vacuum cleaner to a desired position, a user grips the manipulation handle 30 of the vacuum cleaner and then pulls or pushes the vacuum cleaner 1.

In detail, the suction nozzle unit 10 is used for sucking outer air and has a substantially rectangular shape with an opening opened toward the floor. The suction nozzle unit 10 is hinged to the main body 20, and a pivoting lever 3 controls this hinge movement. In addition, for better movement of the suction nozzle unit 10, the suction nozzle unit 10 further includes wheels 2 installed at a rear portion of the suction nozzle unit 10, and a height control knob 4 installed on an upper surface of the suction nozzle unit 10 for height control of the suction nozzle unit 10. The air sucked into the suction nozzle unit 10 is guided to the main body 10 by means of a hose 29. For this purpose, both ends of the hose 29 are connected to the suction nozzle unit 10 and the main body 20, respectively.

In detail, the main body 20 includes a front case 21 for protecting a front portion of the main body 20 and a rear case 22 for protecting a rear portion of the main body 20, and the front and rear portions are fixed with each other by a certain manner such as fitting or screwing. Furthermore, the main body 20 is provided with a dust collecting unit 23 for collecting dusts from the air sucked through the hose 29, a detachable lever 26 for separating the dust collecting unit 23 from the main body 20 in a convenient way, a discharge cover 24 formed in a side of the main body 20 for allowing the air free from foreign particles to be discharged, a lamp 25 for lighting the floor at night so that the vacuum cleaner may be manipulated in a convenient way, a mini nozzle seat 28 concaved in the top of the front case 21, and a mini nozzle 27 selectively received in the mini nozzle seat 28. The mini nozzle 27 may be used for cleaning places that are not directly contacted with the main body of the upright cleaner like a corner and received in the mini nozzle seat 28 during a custody time.

In addition, the main body 20 is also provided on its rear side with a cord hook 36 protruded at upper and lower positions of the main body 20 so that a power line is wound kept in custody thereon, a hose guide 50 that configures at least a part of the hose 29 and is made of strong materials unlike the hose 29, and a holder 51 protruded on the rear side of the main body 20 so as to support the hose guide 50. The hose guide 50 is used for convenient positioning of the mini nozzle 27 when the mini nozzle 27 is used in connection to the hose 29.

Meanwhile, the hose 29 has a freely expandable and contractable bellows shape such that another suction nozzle unit such as the mini nozzle 27 is conveniently used. In addition, the hose 29 has the bellows shape, so its length may be shortened while being kept in custody and elongated over a few times when being used by a user. Thus, to clean a place far away from the main body of the vacuum cleaner 1, such as stair or the like, the main body of the vacuum cleaner 1 is fixed and only the hose 29 extends to a desired position such that the mini nozzle 27 reaches the cleaning place to perform cleaning more conveniently.

In addition, a carrying handle 40 is formed at the top of the front case 21. The hose 29 may be seated on the carrying handle 40 in a shrunk state. The carrying handle 40 is used when a user wishes to transfer the vacuum cleaner to another place, and is gripped by the user during the transfer operation. The carrying handle 40 may be used not only for holding and carrying the vacuum cleaner but also for seating the hose 29 thereon.

In detail, the manipulation handle 30 includes a handle grip 31 for a user to grip conveniently while the vacuum is operating, and an operation switch 34 formed at a predetermined position of the handle grip 31 and used for controlling operation of the vacuum cleaner itself such as initiation of operation of the vacuum switch and suction force of the vacuum cleaner. In addition, a length of the manipulation handle 30 may be conveniently adjusted. In more detail, for adjustment of length, the manipulation handle 30 includes an extension pipe 33 extended downward to the handle grip 31, and a fixed pipe 32 that supports the extension pipe 33 and allows the extension pipe 33 to be moved through it by means of selective manipulation of an extension lever 35 so that the length of the manipulation handle 30 may be shortened or elongated.

Figure 3:
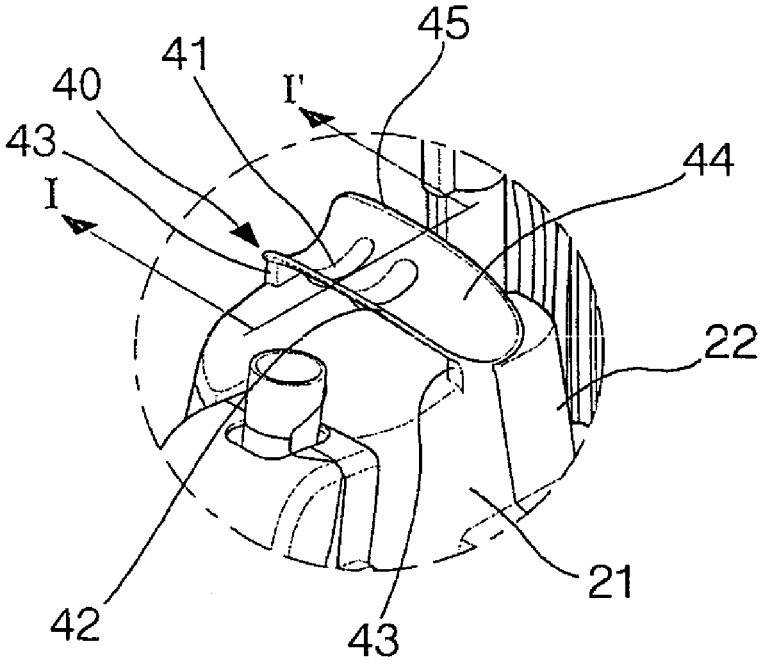
FIG. 3 is a detailed perspective view of an upright vacuum cleaner according to the present invention.
Figure 4:
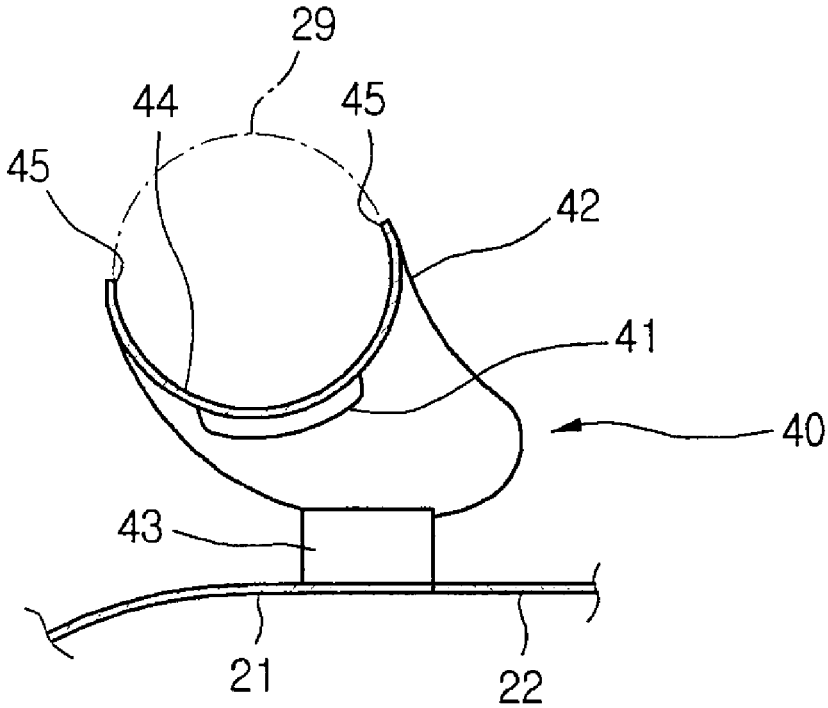
FIG. 4 is a sectional view taken along the line I-I' of FIG. 3.

FIG. 3 is a detailed perspective view of the carrying handle and FIG. 4 is a sectional view taken along the line I-I' of FIG. 3.

Referring to FIGS. 3 and 4, the carrying handle 40 is protruded upward from a top surface of the front case 21. In detail, the carrying handle 40 includes a pair of spacers 43, which are formed spaced apart from each other at both sides of the top surface of the front case 21 and configured to have a space between the pair of spacers 43 such that a user's hand is inserted, and a smoothly curved portion 42 of which both ends are connected with the pair of spacers 43, and a seat latch 45 inwardly curved from both edges of the curved portion 42 such that the hose 29 is correctly seated on an inner surface of the curved portion 42.

In detail, the curved portion 42 is to allow a user to conveniently grip the carrying handle 40 and is convexly curved in a front and rear direction and an upper and lower direction. In addition, the curved portion has a U-shaped section such that the hose 29 is seated thereon. Since the curved portion 42 is convexly curved in the front and rear direction, the hose 29 as escaped from the curved portion 42 can be conveniently guided to a rear side. In addition, since the grip position of the curved portion 42 is exactly matched with the gravity center (see 55 of FIG. 5) of the vacuum cleaner, it is possible to use the carrying handle more conveniently.

The curved portion 42 also includes a groove portion 41 such that when a user grips the curved portion 42, user's fingers are disposed at exact positions. The upper surface of the curved portion 42 on which the hose 29 is seated, is made to have the same shape as that of the hose 29 and has a hose seat surface 44.

The carrying handle 40 having the above-mentioned structure gives the following convenient advantages. In detail, the reason the carrying handle 40 is formed at the top of the front case 21 is to match the gravity center of the vacuum cleaner with the position of the carrying handle 40 in the vertical direction, thereby allowing the vacuum cleaner to be placed at an exact position without leaning to one direction. In other words, since the gravity center of the vacuum cleaner leans to the front direction due to the weight of the suction nozzle unit 10, the carrying handle 40 is preferably formed at the front case 21 so as to make up for the leaning of the gravity center.

Also, since the hose 29 is wound via a roundabout way of the front side of the vacuum cleaner and seated, convenience in use of the vacuum cleaner 1 is enhanced. In detail, if the hose 29 is seated on a rear upper surface of the vacuum cleaner 1, the hose 29 may be in contact with a user's body during a pushing and pulling operation of the vacuum cleaner 1, which hinders the convenient manipulation of the vacuum cleaner 1. However, when the hose 29 is disposed at the front side of the vacuum cleaner 1, a carrying distance of the vacuum cleaner 1 in the front and rear direction can be lengthened.

In addition, since the carrying handle 40 has two functions at the same time, i.e., the function of the carrying handle and the function of the seat of the hose 29, the construction of the vacuum cleaner 1 is further simplified and convenience in use of the vacuum cleaner 1 is further enhanced.

Further, since the hose 29 is curved via the front side of the vacuum cleaner 1, the hose 29 can be extended as long as that. Therefore, when the hose 29 is separated from the main body of the vacuum cleaner 1, the cleanable area can be extended as Long as that.

Next, the relationship between the carrying handle 40 and the hose 29 will be described. When the upright vacuum cleaner is used as the original construction, the hose 29 is inserted into the upper surface of the carrying handle 40 and is fixed thereon. At this time, since the hose 29 and the hose seat surface 44 have an equal or similar shape, the hose 29 can be exactly seated on the hose seat surface 44. Also, the hose 29 can be fixed by the seat latch 45. Accordingly, once the hose 29 is inserted and external force is not applied, it is not released from the hose seat surface 44. Under the circumstance that the hose 29 is released from the carrying handle 40, another hose such as the mini nozzle 27 is inserted into an end portion of the hose guide 50 so that the role of the vacuum cleaner may extend.

Meanwhile, when a user wishes to carry the vacuum cleaner 1, the user can conveniently carry the vacuum cleaner 1 by inserting his/her one hand into the space formed by the pair of spacers 43 below the carrying handle 40 and lifting the carrying handle 40 upward. Also, in order for the user to have a comfortable feeling when gripping the carrying handle 40, the curved portion 42 is smoothly curved. In addition, since the groove portion 41 is formed at a position where the user's fingers contact, the position of the curved portion 42 is more exactly guided and accordingly the user has more comfortable feeling.

Figure 5:
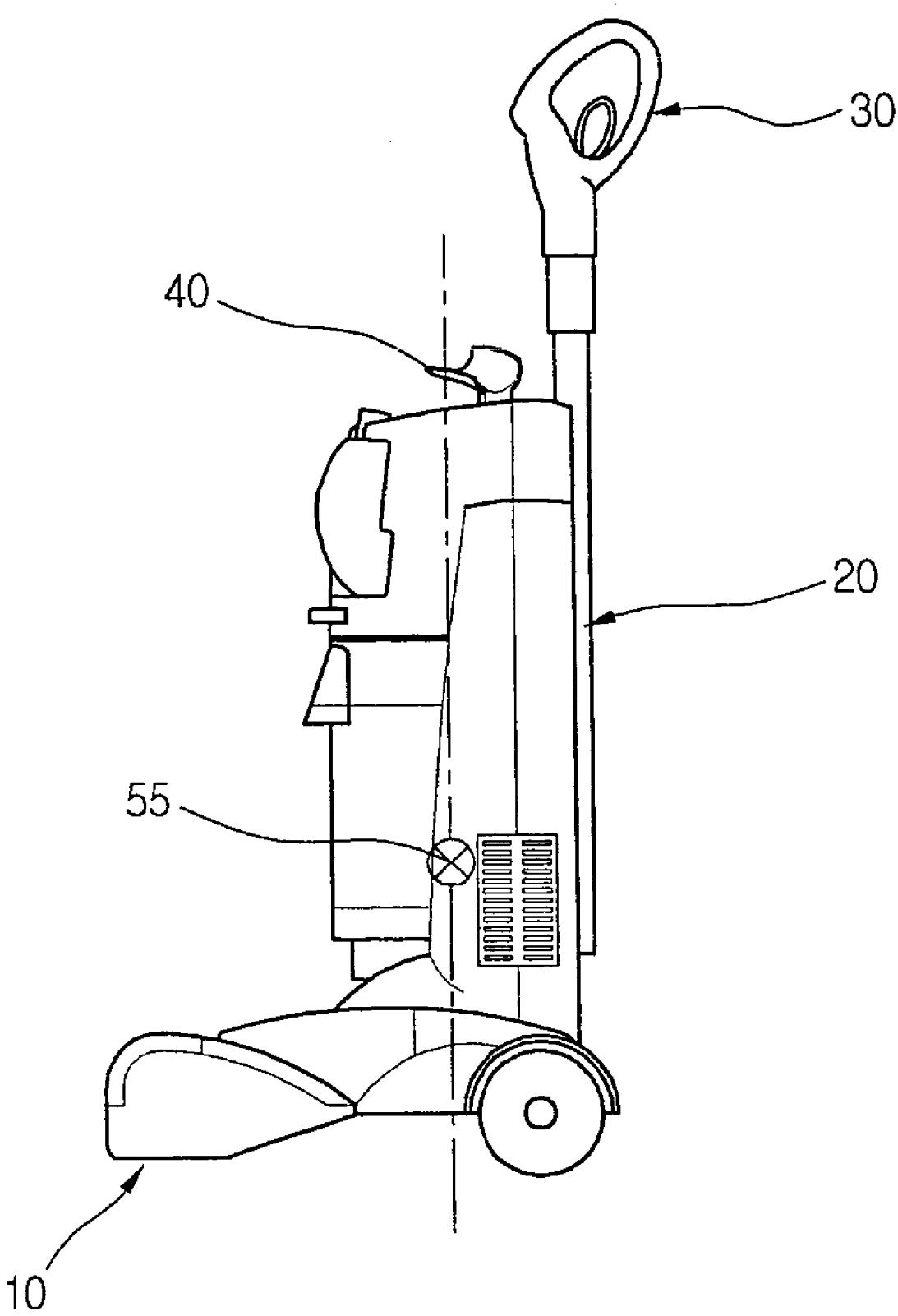
FIG. 5 is a side view of an upright vacuum cleaner according to the present invention and illustrates an operation of the vacuum cleaner.

FIG. 5 is a side view of an upright vacuum cleaner according to the present invention and illustrates an operation of the vacuum cleaner.

Referring to FIG. 5, the carrying handle 40 is disposed on the center line of gravity of the vacuum cleaner 1. Accordingly, if the user grips the carrying handle 40 and lifts the vacuum cleaner so as to transfer the vacuum cleaner 1, the vacuum cleaner 1 can be lifted upward from an exact position without any shaking in the front and rear direction and can be also carried with still maintaining the horizontal position when the vacuum cleaner 1 is placed on the floor.

Also, it is natural that the gravity center 55 corresponds to the gravity center of the whole elements including the suction nozzle unit 10, the main body 20 and the manipulation handle 30 and the carrying handle 40 is installed on the center of gravity in the left and right direction.

According to the upright vacuum cleaner provided in the present invention, since the carrying handle used in carrying the vacuum cleaner and the hose seat are designed to have the same function, the whole construction of the vacuum cleaner is simplified and made conveniently.

Also, convenience in using the vacuum cleaner is further enhanced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An upright vacuum cleaner, comprising:

a suction nozzle device through which outer air is sucked into the vacuum cleaner;

a main body through which the air sucked in through the suction nozzle device is introduced, the main body comprising cases that include a front case that protects a front side of the main body and a rear case coupled with the front case and formed at a rear side of the front case;

a hose connected to the suction nozzle device and the main body, that introduces the air sucked through the suction nozzle device into the main body;

a carrying handle formed on the front case, the carrying handle having an upper surface on which the hose is seated and gripped by a user while being transferred; and a manipulation handle formed at an upper portion of the main body and gripped by a user during a cleaning operation to hold and manipulate the vacuum cleaner.

2. The upright vacuum cleaner according to claim 1, wherein the carrying handle comprises an upper surface having a hose seat surface that is the same in shape as the hose.

3. The upright vacuum cleaner according to claim 1, wherein the carrying handle is formed on a vertical line that is identical to a center of gravity of the vacuum cleaner.

4. The upright vacuum cleaner according to claim 1, wherein the carrying handle comprises a groove portion that protrudes from a lower surface thereof such that a user can conveniently grip the carrying handle.

5. The upright vacuum cleaner according to claim 1, further comprising a spacer interposed between the carrying handle and the main body such that the carrying handle is spaced apart from the main body at a predetermined distance.

6. The upright vacuum cleaner according to claim 1, wherein the carrying handle comprises a hose latch curvedly formed, for exactly seating the hose.

7. The upright vacuum cleaner according to claim 1, wherein the carrying handle comprises a curved portion which is smoothly curved in an upward direction and/or a frontward direction.

8. The upright vacuum cleaner according to claim 1, wherein the carrying handle comprises a curved portion convexly formed in a frontward direction such that the hose is guided to a rear side.

9. An upright vacuum cleaner, comprising:

a suction nozzle device through which outer air is sucked into the vacuum cleaner;

a main body through which the air sucked in through the suction nozzle device is introduced, the main body comprising cases that include a front case that protects a front side of the main body and a rear case coupled with the front case and formed at a rear side of the front case;

a flexible and extendable hose connected to the suction nozzle device and the main body, that introduces the air sucked in through the suction nozzle device into the main body;

a carrying handle on which the hose is seated, gripped by a user while transferring the main body, and formed integrally with and spaced apart by a predetermined distance from the front case; and a manipulation handle formed on an upper portion of the main body and gripped by a user during a cleaning operation to hold and manipulate the vacuum cleaner.

10. The upright vacuum cleaner according to claim 9, wherein the carrying handle comprises an upper surface having a hose seat surface that is the same in shape as the hose.

11. The upright vacuum cleaner according to claim 9, wherein the carrying handle is formed convexly toward a frontward direction such that a user's hand contacts a position on a line that is identical to a center of gravity of the vacuum cleaner.

12. The upright vacuum cleaner according to claim 9, wherein the carrying handle comprises a curved portion formed convexly toward a frontward direction such that after the hose is seated on the carrying handle, the hose is further extended toward a rear side.

13. The upright vacuum cleaner according to claim 9, further comprising a hose guide formed at a predetermined portion of the hose such that the hose is separated from the main body and is independently used.

14. The upright vacuum cleaner according to claim 9, wherein the hose comprises a hose latch formed at both ends thereof such that after the hose is seated on the carrying handle, the position of the hose is fixed.

15. An upright vacuum cleaner, comprising:

a nozzle formed at a lower side of the vacuum cleaner, through which outer air is sucked into the vacuum cleaner;

a main body including at least a dust collection device;

a carrying handle formed on a vertical line of the main body that is identical to a center of gravity of the vacuum cleaner and conveniently gripped by a user while transferring the vacuum cleaner; and a hose separatably and fixedly seated on an upper surface of the carrying handle, that guides the air sucked in through the nozzle to the main body.

16. The upright vacuum cleaner according to claim 15, wherein the main body comprises:

a front case that protects a front side of the main body, the front case having an upper portion where the carrying handle is formed; and a rear case that protects a rear side of the main body.

* * * * *